United States Patent [19]

Kuroyahagi et al.

[11] 3,967,483

[45] July 6, 1976

[54] DEVICE FOR ADJUSTING A PRELOAD AND ADDITIONALLY COMPENSATING THE SLIDE IN A PRESS

[75] Inventors: Moritaka Kuroyahagi, Machida; Yoshinobu Kimura, Chiryu; Hirotoku Takeuchi; Masao Takegami, both of Aichi, all of Japan

[73] Assignees: Aida Engineering Kabushiki Kaisha; Zaidan Hojin Kikai Shinko Kyokai, Tokyo, both of Japan

[22] Filed: Aug. 13, 1974

[21] Appl. No.: 496,995

[30] Foreign Application Priority Data

Aug. 18, 1973 Japan ..... 48-92088

[52] U.S. Cl. ..... 72/21; 72/441

[51] Int. Cl.[2] ..... B21J 9/20

[58] Field of Search ..... 72/454, 441, 446, 8, 72/21, 455; 100/257

[56] References Cited

UNITED STATES PATENTS

| | | | |
|---|---|---|---|
| 1,774,245 | 8/1930 | Strout | 72/446 |
| 3,280,394 | 10/1966 | Clements | 100/257 |
| 3,348,406 | 10/1967 | Holberson | 72/446 |
| 3,687,069 | 8/1972 | Helrigel | 100/257 |

*Primary Examiner*—C.W. Lanham
*Assistant Examiner*—Gene P. Crosby
*Attorney, Agent, or Firm*—Holman & Stern

[57] ABSTRACT

A device is disclosed for positioning the slide of a press to compensate for insufficiencies of the stroke. A predetermined preload is first adjusted to the slide to take up clearances which may be present between the various moving parts of the press, dies and material to be processed. A slide preload compensating amount is then additionally adjusted to the slide equivalent to the amount of deformation of compression which the slide and frame will undergo during a working stroke. Therefore, the vertical position of the slide is established with the insufficiencies of the stroke eliminated. The device comprises in combination a worm mechanism having a worm shaft for adjusting the vertical position of said slide, an oil pressure motor for driving said worm mechanism, a torque limiter through which the driving force from said oil pressure motor is transmitted to said worm mechanism and a rotary pulse generator adapted to be rotated by said worm shaft of the worm mechanism and in which the rotation of the oil pressure motor is controlled by a servo valve adapted to be actuated at a value obtainable from the comparison between a pulse amount generated from said rotary pulse generator and a pulse corresponding to a predetermined frame deformation compensating amount and by an electromagnetic valve adapted to control the rotation direction of the oil pressure motor.

3 Claims, 3 Drawing Figures

DEVICE FOR ADJUSTING A PRELOAD AND ADDITIONALLY COMPENSATING THE SLIDE IN A PRESS

BACKGROUND OF THE INVENTION

This invention relates to a slide position adjusting device in a press and more particularly, to a device designed to adjust the vertical position of the slide in a press by applying a predetermined preload on the slide and compensate for any deformation of the press frame or slide.

The operation of compensating for the deformation of the press frame or slide discussed herein means that compensation is made for any insufficiency of the downward movement of the upper die with respect to the lower die for a proper pressing operation due to compressive forces applied on the slide which will occur when the frame is extended or deformed, without interrupting the press operation, whereby the die assembly may have a proper height for the pressing operation.

The slide position adjusting operation in a press has been conventionally performed by recording the height of each die assembly each time a new die assembly different from the die assembly previously used is employed in a press and adjusting the position of the slide based on the recorded die height. Therefore, although the slide may be positioned in any optional position, since the height of the die assembly varies after regrinding of one or the other or both the dies in the die assembly, the setting for the height of the die assembly for a proper pressing operation has to be varied accordingly.

When it is desired to numerically control the preload on the slide, after each regrinding of the die or dies, it is necessary to precisely measure the height of the die assembly and vary the setting of the die height based on the measured die height. Such a procedure is a time consuming and tedious operation resulting in lowering of the pressing operation efficiency in a press in which the die assembly is incorporated.

SUMMARY OF THE INVENTION

Therefore, one principal object of the present invention is to provide a device for adjusting a preload to be applied on the slide in a press and compensating for any insufficiency of the preload on the slide; which can effectively eliminate the disadvantages inherent in the prior art devices of the above type by eliminating the necessity of measuring the height of a die assembly and varying the setting of the die height each time after one or the other die or both the dies of the die assembly have been reground.

Another object of the present invention is to provide a device for adjusting a preload to be applied on the slide in a press and additionally compensating for any deformation of the press frame or slide while the distance between the upper and lower dies in a press is being maintained at a die height value proper for a particular pressing operation, a preload to be applied on the slide is first adjusted and thereafter, any insufficiency of the preload which may be caused by any deformation of the press is compensated for in a simple manner and in a brief period of time.

According to the present invention, there has been provided a device for adjusting a preload to be applied on the slide in a press and additionally compensating for any deformation of the slide which comprises a worm mechanism having a worm shaft for adjusting the vertical position of said slide, an oil pressure motor for driving said worm mechanism through a torque limiter and a rotary pulse generator to be imparted its rotation from the worm shaft of said worm mechanism, the rotation said oil pressure motor being controlled by a servo valve adapted to be actuated at a value obtainable from the comparision between a number of pulses generated from said rotary pulse generator and a pulse amount corresponding to a predetermined frame deformation compensating amount and by an electromagnetic valve adapted to control the rotation direction of said motor.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the same in any way.

BRIEF DESCRIPTION OF THE DRAWINGS

The accompanying drawings show one embodiment of the invention in which.

PREFERRED EMBODIMENT OF THE INVENTION

Figure 1:
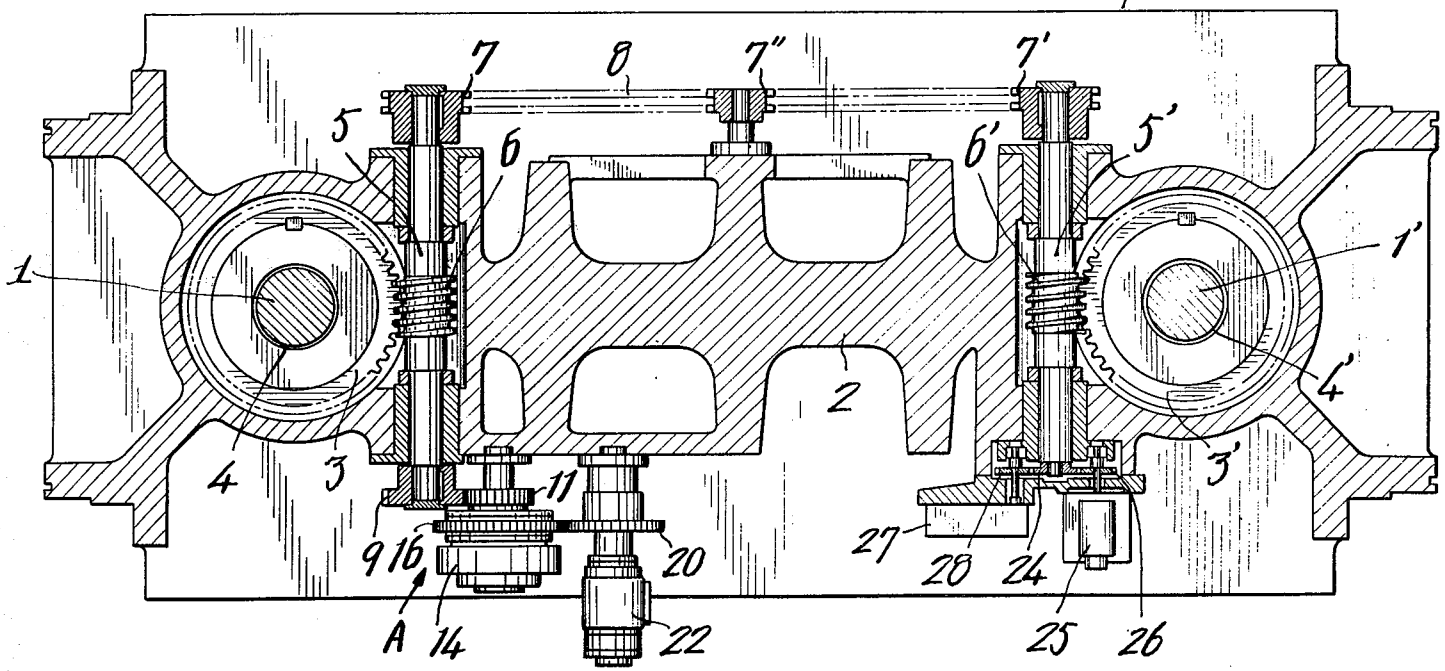
FIG. 1 is a plan view in partial section of the threaded engaging arrangement for adjusting the vertical position of the slide in a press according to one embodiment of slide preload adjusting and compensating device of the invention.

The present invention will be now described referring to the accompanying drawings which show one preferred embodiment of the invention for illustration purpose only. In FIG. 1, numerals 1 and 1' denote conventional threaded shafts for adjusting the vertical position of the slide S in a press and the shafts extend vertically in a laterally spaced relationship to each other. The threaded shafts 1 and 1' are, respectively, in meshing engagement with threaded bores 4 and 4' in worm wheels 3 and 3' which are rotatably mounted on a support frame 2 which is a part of the slide S. The worm wheels 3 and 3' are, respectively, in meshing with worms 6 and 6' which are integral with worm shafts 5 and 5', respectively, which are in turn suitably supported in the frame 2. The worm shafts 5 and 5' are adapted to be rotated in unison by means of an endless chain 8 which is trained over sprockets 7 and 7' mounted at one end of the worm shafts 5 and 5', respectively and an intermediate sprocket 7'' which is mounted at the free end of a stub shaft suitably supported in the frame 2. A gear 9 is mounted at the other end of the worm shaft 5 and in meshing with a mating gear 11 rotatably supported on a support shaft 10 which is fixedly mounted in the frame 2 on the side of the frame 2. The gear 11 has a boss 12 which has an integral flange 13 at an intemediate position between the opposite ends thereof. A pneumatic cylinder 14 is fixedly secured to the outer or free end of the gear boss 12 and receives a piston 15 therein for movement in the cylinder. An annular intermediate gear 16 is rotatably mounted on the boss 12 between the flange 13 and piston 15. Friction linings 17 and 18 are interposed between the flange 13 and intermediate gear 16 and between the piston 15 and intermediate gear 16, respectively. The annular intermediate gear 16 is in meshing with a drive gear 20 rotatably mounted on a stub shaft 19 which is fixedly mounted in and extends from the frame 2 on the side thereof where the support shaft 10 extends. The drive gear 20 is fixedly secured to the output shaft 23 of an oil pressure motor 22 which is mounted on a support structure 21 fixedly secured to the frame 2.

The other worm shaft 5' has a gear 24 fixedly secured to the other end thereof and the gear is in meshing engagement with a mating gear 26 on the rotary shaft of a rotary pulse generator (RPG) 25. The gear 24 is in turn meshing with a gear 28 on the shaft of a die height indicator 27 which is mounted on the frame 2.

Figure 2:
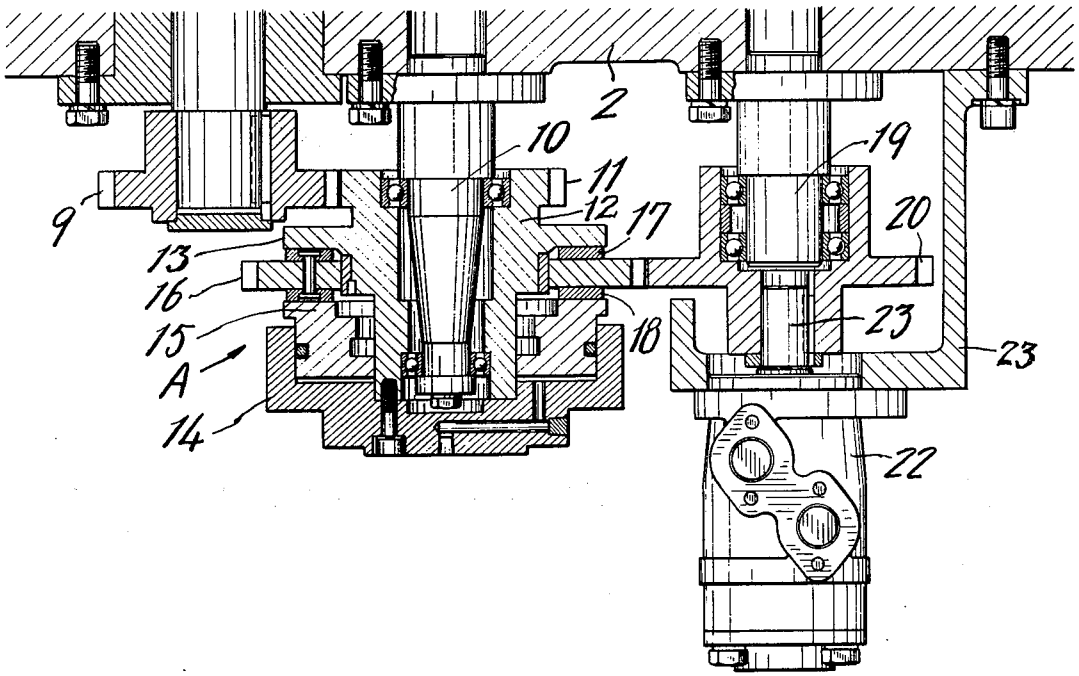
FIG. 2 is a plan view in partial section of the torque limiter which constitutes an essential part of said device of FIG. 1.

The above-mentioned flange 13, intermediate gear 16, piston 15, friction linings 17, 18 and pneumatic cylinder 14 cooperate with each other to provide a torque limiter which is generally shown by character reference A in FIG. 1 and 2.

The amount of preload to be applied to the slide S is suitably set at a suitable value on the order of a fraction of the pressing capacity of a particular press in which the preload adjusting and additional compensating device of the invention is incorporated, depending upon the type of the press. In the operation of the press, with the slide properly positioned at the lower dead point, an abutting pressurization block is interposed between the upper and lower dies when the press is operated for performing a cycle of material punching operation. Alternately, when the press is operated for performing a cycle of material drawing or bending, a processed material is interposed between the upper and lower dies. In either case, compressed air is then supplied to the pneumatic cylinder 14 and the oil pressure motor 22 is rotated to rotate the output shaft 23 of the motor 22. The rotation of the shaft 23 causes the drive gear 20 thereon to rotate the intermediate gear 16 mounted on the boss 12. The rotating intermediate gear 16 rotates the flange 12 through the friction lining 17 and accordingly, the gear 11. The rotating gear 11 rotates the gear 9 which in turn rotates the worm shaft 5 as well as the worm 6 on the worm shaft. The rotating worm shaft 5 rotates the worm gear 3 which in turn moves the slide height adjusting threaded shaft 1 upwardly or downwardly depending upon the rotational direction of the motor 22. Simultaneously, the rotation of the worm shaft 5 is transmitted to the other worm shaft 5' through the sprocket and chain transmission arrangement 7, 7' and 8. The rotating work shaft 5' in turn upwardly or downwardly moves the other slide height adjusting threaded shaft 1' through the associated worm 6', worm gear 3' and threaded bore 4'. In such a case, if the air pressure to be applied to the pneumatic cylinder 14 is adjusted to a value corresponding to a predetermined preload to be applied to the slide S, the slide S can be applied the predetermined preload thereto and clearances which may be present between the various moving parts of the press, dies and material to be processed, respectively, can be absorbed to thereby maintain them in a tightly contacting relationship for proper operation.

Figure 3:
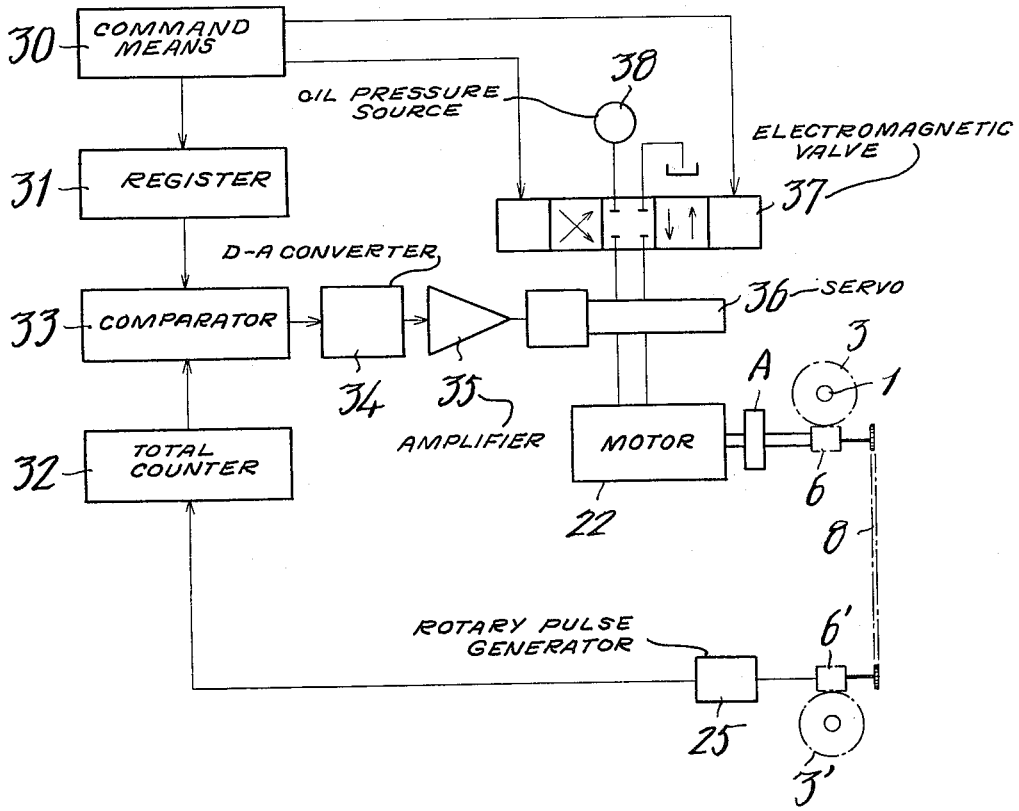
FIG. 3 is a diagram of the numerical control means for adjusting the preload on the slide to compensate for any insufficiency of the preload due to deformation of the press, which control means is to be employed in conjunction with the device of FIG. 1.

According to the present invention, the preload adjustment for the slide or the additional compensation for the preload on the slide in proportion to any deformation amount of the press in a practial operation of pressing in the press will be carried out in the following manner:

The slide preload compensating amount is previously set depending upon the type of pressing operation to be performed in a particular press. For example, the preload compensating amount is set within the range of 0.3–0.8 mm for a 200 ton press. The compensating amount is previously memorized in a register 31 by a command means 30 (FIG. 3) in the manner as will be in detail described hereinafter.

In the slide preload compensating operation, the slide S, which is now at its lower dead point position, is first raised from that position and the oil pressure motor 22 is then operated in the manner as will be in detail described hereinafter.

In the embodiment of FIG. 1, a rotary pulse generator 25 is provided to be rotated from the worm shaft 5' through meshing gears 24 and 26, adapted to generate 10 pulses per rotation. If the slide height is adjusted by 0.01 mm, the pulse generator 25 generates 1 pulse. With this ratio, when the slide preload compensating amount range is assumed as being 0–2.99 mm, the compensating amount range is converted into pulse numbers by the command means 30 and memorized in the register 31 by the command means.

Pulses from the rotary pulse generator 25 are added together in a total counter 32 and the addition result is compared with the number of pulses registered in the register in a comparator 33. The comparision result or difference between the number of pulses from the total counter 32 and the registered number of pulses is converted into an electric value in a D–A converter 34. The electric value is fed to an amplifier 35 where the electric value is amplified sufficiently to operate a servo valve 36. The command means 30 incorporates therein a ± discriminator which discriminates between the slide rise (−) and slide descend (+) to thereby move an electromagnetic valve 37 to raising direction or lowering direction. In this way, pressure oil from a source of oil pressure 38 is fed through the electromagnetic valve 37 and servo valve 36 to the oil pressure motor 22 whereby the motor is rotated in either the slide raising or slide lowering direction. When the difference between the above-mentioned two types of numbers of pulses compared in the comparator 33 shows zero, the oil pressure motor 22 ceases to rotate whereupon the slide height adjusting or additional compensating operation is completed.

As mentioned hereinabove, since the device of the present invention is designed to adjust the slide preload adjusting and perform additional frame deformation compensation even if the die or dies are reground, it will not be necessary to vary the die height setting value through any remeasurement of the die height whereby error in setting the die height which would be otherwise inevitable in the prior art slide preload adjusting or deformation compensating devices can be eliminated. As a result, the dies and/or press will be free of any adamage which would be otherwise seen in the setting of the die height after the regrinding of the dies. Furthermore, according to the present invention, since it is only necessary to set a slide deformation compensating amount, the slide position adjusting operation can be performed with a high efficiency. Especially, even if the press is operated by different operators, once determined, the slide deformation compensating amount remains unchanged to thereby ensure the production of products of uniform quality in any particular pressing operation.

In the foregoing, description has been made of only one embodiment of the invention, but it will readily occur to those skilled in the art that the same is illustrative in nature, but does not limit the scope of the invention in any way. The scope of the invention is only limited by the appended claims.

What is claimed is:

1. A device for providing a preload to be applied by the slide in a press and additionally compensating for any deformation of the slide, comprising: a worm mechanism having a worm shaft for moving the vertical position of a die on said slide; an oil pressure motor for driving said worm mechanism through a torque limiter; and a rotary pulse generator with its rotation imparted from the worm shaft of said worm mechanism; the rotation of said oil pressure motor being controlled by a servo valve adapted to be actuated at a value obtainable from the comparison between a pulse amount generated from said rotary pulse generator and a pulse amount corresponding to a predetermined slide deformation compensating amount and by an electromagnetic valve adapted to control the rotation direction of said motor.

2. The device as set forth in claim 1, in which said torque limiter comprises a friction transmission mechanism the transmission force of which is controlled by air pressure.

3. The device as set forth in claim 1, in which the circuit for controlling the rotation of said oil pressure motor includes a register adapted to numerically memorize therein a pulse amount corresponding to a desired preload compensating amount, a counter for adding pulse amounts from said rotary pulse generator, a comparator adapted to compare between the pulse amount from the register and that from the counter and said servo valve adapted to actuate said oil pressure motor at the resultant value from said comparision by said comparator.

* * * * *